US006227526B1

(12) United States Patent
Morton

(10) Patent No.: US 6,227,526 B1
(45) Date of Patent: May 8, 2001

(54) STEAM DISTRIBUTION DEVICE AND METHOD

(75) Inventor: Willard E. Morton, Carver, MN (US)

(73) Assignee: Pure Humidifier Co., Chaska, MN (US)

( * ) Notice: Subject to any disclaimer, the term of this patent is extended or adjusted under 35 U.S.C. 154(b) by 0 days.

(21) Appl. No.: 09/274,558

(22) Filed: Mar. 23, 1999

Related U.S. Application Data

(63) Continuation-in-part of application No. 09/056,574, filed on Apr. 7, 1998, now Pat. No. 6,065,740.

(51) Int. Cl.[7] ..... B01F 3/04

(52) U.S. Cl. ..... 261/115; 261/159; 261/DIG. 15; 261/DIG. 76; 55/428.1; 55/DIG. 23; 239/139

(58) Field of Search ..... 55/428, 428.1, 55/431, DIG. 23; 96/191, 192, 374; 95/241; 239/139; 261/115, 118, 159, 160, 161, DIG. 15, DIG. 76

(56) References Cited

U.S. PATENT DOCUMENTS

| | | | |
|---|---|---|---|
| 3,386,659 | | 6/1968 | Rea . |
| 3,724,180 | | 4/1973 | Morton et al. . |
| 3,857,514 | | 12/1974 | Clifton . |
| 3,923,483 | | 12/1975 | Hilmer et al. . |
| 4,265,840 | | 5/1981 | Bahler . |
| 4,384,873 | | 5/1983 | Herr . |
| 4,509,965 | | 4/1985 | Morton . |
| 4,913,856 | | 4/1990 | Morton . |
| 5,126,080 | | 6/1992 | Morton et al. . |
| 5,277,849 | | 1/1994 | Morton et al. . |
| 5,372,753 | | 12/1994 | Morton . |
| 5,376,312 | | 12/1994 | Morton et al. . |
| 5,516,466 | | 5/1996 | Schlesch et al. . |
| 5,543,090 | | 8/1996 | Morton et al. . |
| 5,942,163 | * | 8/1999 | Robinson et al. ..... 261/118 |
| 6,065,740 | * | 5/2000 | Morton ..... 261/115 |

FOREIGN PATENT DOCUMENTS 489759 6/1970 (CH) .

* cited by examiner

*Primary Examiner*—C. Scott Bushey
(74) *Attorney, Agent, or Firm*—Nelson R. Capes; Rider, Bennett, Egan & Arundel

(57) ABSTRACT

A steam distribution device for a steam humidification system includes a source of steam, a horizontally mounted steam dispersion element for receiving steam from the source of steam and for dispersing a portion of the steam into an air stream, a horizontally mounted jacket partially surrounding the steam dispersion element and unconnected to the source of steam for maintaining the temperature of the steam dispersion element at about the temperature of the steam, the jacket being in flow communication with the dispersion element and receiving steam from the dispersion element, and a condensate collection element separate from the source of steam and connected to the jacket for collecting condensation from the jacket. In a second embodiment, the jacket substantially surrounds the steam dispersion element and is spaced from the dispersion element creating a chamber therebetween. Aligned orifices in the dispersion element and the jacket disperse steam into the air stream.

19 Claims, 3 Drawing Sheets

STEAM DISTRIBUTION DEVICE AND METHOD

This is a continuation-in-part of co-owned, U.S. patent application Ser. No. 09/056,574, filed Apr. 7, 1998, for a Steam Distribution Device and Method now U.S. Pat. No. 6,065,740.

BACKGROUND OF THE INVENTION

This invention relates to a steam distribution device for a steam humidifier system.

Humidification may be accomplished by a variety of techniques, such as spraying finely atomized water into the atmosphere, by employing evaporative belts that are continuously moistened by water and which are presented to an air flow path, and by direct steam injection.

Steam injection is undoubtedly the most efficient humidification system in situations requiring very large quantities of vapor to be discharged and particularly for industrial humidification. Steam injection systems, however, must be properly designed, since humidification by wet steam is accompanied by water droplets emerging from the unit, thus wetting ducts, ceilings, floors, and surrounding equipment.

Steam humidification is usually accomplished by conducting steam through a pipe having perforations and into the atmosphere to be humidified. If wet steam emerges from the perforations, drip pans are provided to collect the water. A more desirable technique is to minimize the emergence of wet steam from the perforations.

There are generally speaking two methods to accomplish this. In the first method, the perforated steam dispersion tube is surrounded by a heated jacket so that the steam dispersion tube is already hot at the time the humidistat calls for steam. Because the dispersion tube is at or close to steam temperature, little condensation is produced when live steam enters the dispersion tube.

A problem with this type of system is that the pre-heated jacket causes the owner to incur extra costs for air conditioning, since air conditioning systems are frequently run at the same time as humidification systems.

To avoid the extra air conditioning costs imposed by a pre-heated jacket system, cold tube systems have been used. In these systems, the challenge is to find a means of getting rid of condensate from the unjacketed cooled tube or tubes without condensate being carried with the steam into the duct or air handler. A single wall tube with no buffer from the cool airstream will create much more condensate. Condensate creation consumes BTUs that are wasted.

Since none of the so called "atmospheric" or cold tubes utilize a jacketed tube, all must be inclined or vertical instead of level so that gravity helps with the condensate disposal, or, if the tubes are level, the headers must be angled to promote drainage. This results in an apparatus that is more bulky and difficult to install. In some cases, the less efficient use of the cross section of the duct or air handler can result in unwanted loss of distribution surface. Other systems use "fenders" or structures that insulate the cold tube from the air stream in an attempt to keep the dispersion tube at a temperature higher than that of the air stream. These structures also take up space in the duct. Furthermore, these systems usually disperse steam downstream which accelerates the steam and lengthens the vapor trail. Such systems also usually include special nozzles in the orifices of the dispersion tube to permit steam to escape while preventing the escape of condensate.

A jacketed dispersion tube system of the prior art is illustrated in FIG. 1. The humidification system has a source of steam S which is connected by piping to a jacket J at point A in the Figure. The jacket J is internally baffled so that steam is forced to the outboard end of the jacket and then flow is reversed, the steam flowing back towards the separator R where the steam/condensate exits the tube at point B and is forced into the separator R at point C. The separator R performs a function of letting the condensate run to the steam trap, while the dry steam rises and sits against the valve V. The entire device stays hot, ready for the inflow of steam through the valve V when the humidistat calls for humidity.

When the valve V is opened, steam enters the injection tube T and flows along the tube T to the closed end E opposite the valve. Steam escapes from the tube T through the orifices O. There is no provision for collecting condensate from the tube T, it being assumed that all condensate is removed from the steam by the separator R and that little condensate is formed in the tube T because the jacket J keeps the temperature of the tube T at or near steam temperature.

FIG. 2 shows another prior art jacketed system with more than one tube. Multiple tubes are used in larger ducts or air handlers to promote the release of steam into as much of the air stream as possible, thereby shortening the vapor trail. The principal of operation is the same as a single tube except that two sources of steam, S1 and S2 are used. One source S1 feed the separator R and the source S2 is limited to tube heating. Because more condensate is created by the extra tubes, isolating the jacket line and trapping it separately is very useful.

A variation on the hot-jacketed system is seen in U.S. Pat. No. 4,265,840 (Bahler). Here, an outer chamber 6 is connected to the steam supply pipe 1. Steam enters the outer chamber 6 and then flows into an inner chamber 7. Steam exits the system through inlet openings 10 communicating with the inner chamber 7 and outlet elements 11 communicating with the environment. Condensate 13 which accumulates on the walls of the outer chamber 6 drains back along these walls to the steam supply pipe 1. In a variation shown in FIG. 2, both the inner chamber 7 and the outer chamber 6 communicate with the steam supply pipe 1.

A problem with the Bahler system is that the walls of the inner chamber 7 are spaced from the walls of the outer chamber 6, which creates a dead space for condensate 13 to accumulate. The walls of the outer chamber 6 will always be exposed to the cool air stream 2, and as can be seen in the patent, condensate will form along these walls. Further, this spacing creates a longer path for steam to travel through the openings 10, 11 than in the system described in the current patent application, so that additional condensate may form. The unjacketed collector 1 will also be exposed to the cool air stream and will produce condensate which will blow into the dispersion tube. Also, condensate coming from the dispersion tube will drip into the collector and be recycled into the dispersion tube, because the steam supply header is not separate from the collector. As a result of these problems, it is impossible for the Bahler device to be mounted completely horizontally in the duct. Rather, Bahler depends on gravity to drain condensate out of the outer chamber 6.

An earlier cold tube system is illustrated by U.S. Pat. No. 5,126,080 (Morton). In the Morton patent, a plurality of elongate dispersion tubes are mounted vertically within a duct, or at least not substantially horizontally, so that one end of each tube is higher than the other end, thus promoting drainage of condensate by gravity. The tubes are cold at all times, without a pre-heated jacket. As soon as the steam control valve opens, hot steam will hit the cold dispersion tubes and immediately form condensate. The tubes have internal structure which attempts to force the condensate to drain along the walls of the tube, rather than spitting out through the orifices of the tubes. To promote this, a plurality of vapor nozzles are mounted within the dispersion tube orifices, with the nozzles protruding well inwardly of the inside walls of the tube. As a result, condensate will adhere to the inside surfaces of the tubes and drain downwardly along the inside surface.

To further promote drainage of condensate, both the supply header and the return header in the Morton patent must be tilted at an angle to the horizontal. This produces a bulky installation that takes up expensive space within the duct. A completely horizontal installation of the tubes is not possible.

There is a need for a steam dispersion device that is normally cold (unheated) in periods between humidification, but that rapidly reaches the temperature of live steam when steam is introduced into the dispersion device and wherein the temperature of the dispersion device is maintained at or near steam temperature without the need for a pre-heated jacket surrounding the dispersion tube.

There is also a need for a steam dispersion device that rapidly carries away any condensate that does form in the dispersion tube without the need for the dispersion tube to be tilted at an angle to the horizontal and without the need for supply and return headers to be tilted from the horizontal.

SUMMARY OF THE INVENTION

A steam distribution device for a steam humidification system consists of a source of steam, a horizontally mounted steam dispersion element for receiving steam from the source of steam and for dispersing a portion of the steam into an air stream, a horizontally mounted jacket partially surrounding the steam dispersion element and unconnected to the source of steam for maintaining the temperature of the steam dispersion element at about the temperature of the steam, the jacket being in flow communication with the dispersion element and receiving steam from the dispersion element, and a condensate collection element separate from the source of steam and connected to the jacket for collecting condensation from the jacket. In a second embodiment, the jacket substantially surrounds the steam dispersion element and is spaced from the dispersion element creating a chamber therebetween. Aligned orifices in the dispersion element and the jacket disperse steam into the air stream.

A principal object and advantage of the present invention is that it does not require a separately heated jacket around the steam dispersion tube to prevent the formation of condensate, thus saving on air conditioning costs.

Another object and advantage of the present invention is that it can be mounted perfectly horizontally within a duct, because the force of incoming steam blows condensate out of the dispersion tube into the jacket. Of course, the invention could also be mounted at a slight angle to the horizontal.

Another object and advantage of the present invention is that inclined headers and condensate collectors are not required to collect condensate.

Another object and advantage of the present invention is that the steam dispersion tube quickly reaches and maintains steam temperature immediately after the steam control valve is opened.

Another object and advantage of the present invention is that any condensate that does form in the dispersion tube is carried away by the steam passing through the dispersion tube.

Another object and advantage of the present invention is that it saves space in the duct by allowing the dispersion tubes to be mounted perfectly horizontally and by eliminating the requirement for inclined headers.

Another object and advantage of the present invention is that headers may optionally be eliminated, so that steam is received directly into the dispersion tubes and condensate passes directly into a drain.

DETAILED DESCRIPTION OF THE PREFERRED EMBODIMENTS

Figure 2:
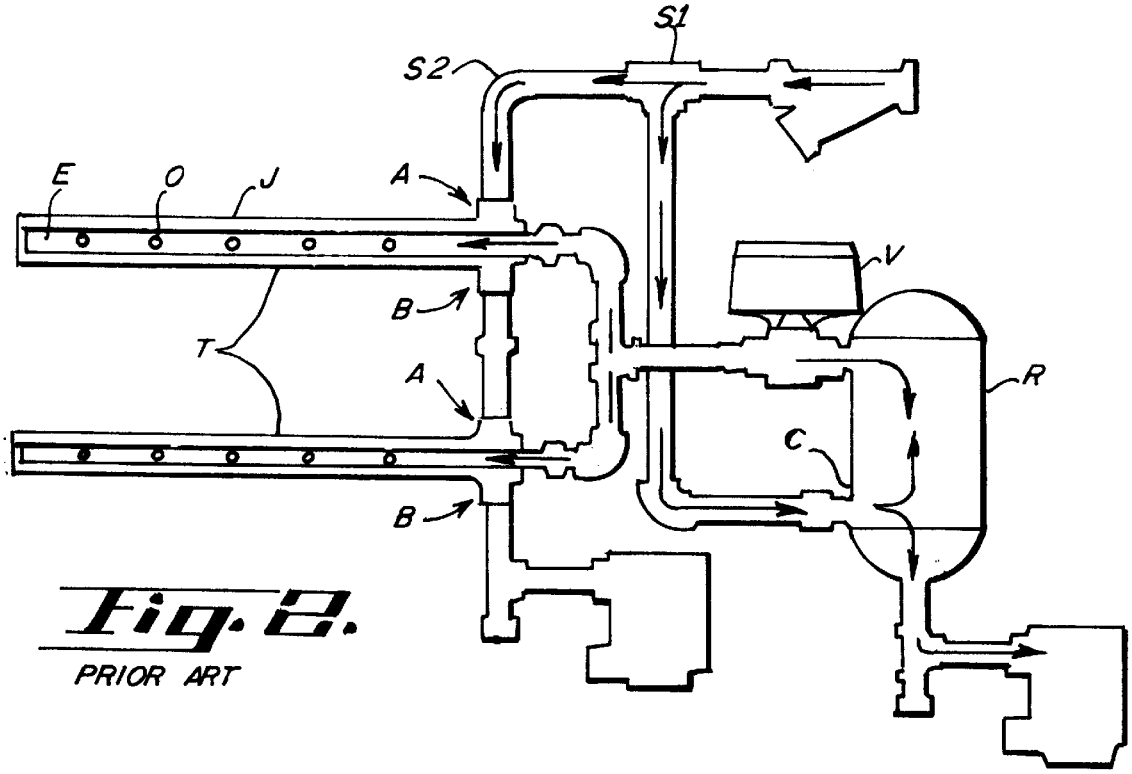
Fig. 2. PRIOR ART
FIG. 2 is a schematic showing a multi-tube, jacketed steam dispersion system of the prior art.
Figure 1:
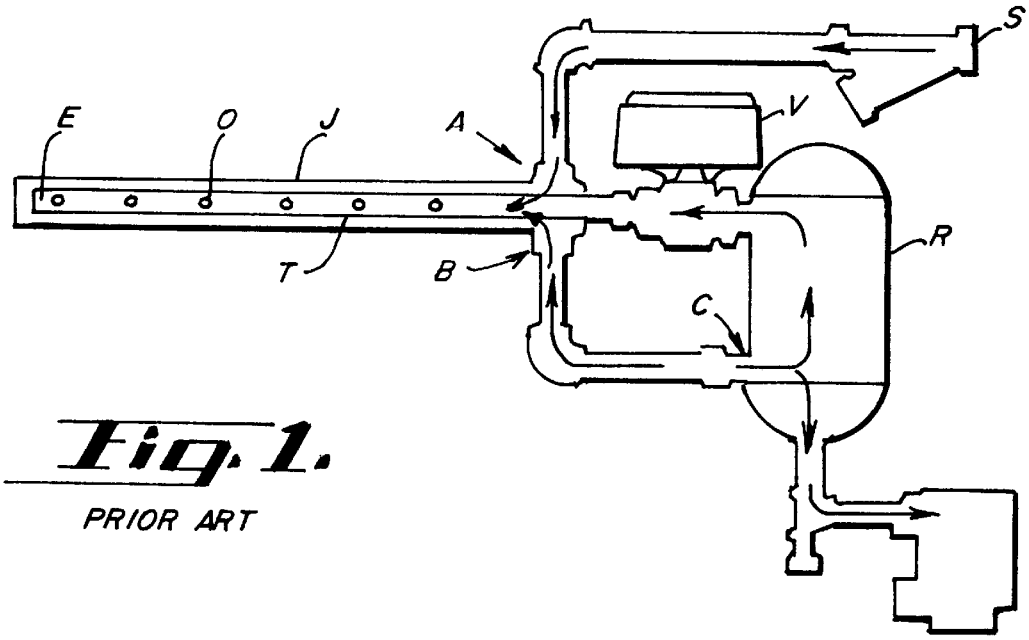
Fig. 1. PRIOR ART
FIG. 1 is a schematic showing a jacketed steam dispersion system of the prior art.

The steam distribution device and method of the present invention is generally indicated in the Figures as reference numeral 10.

Figure 3:
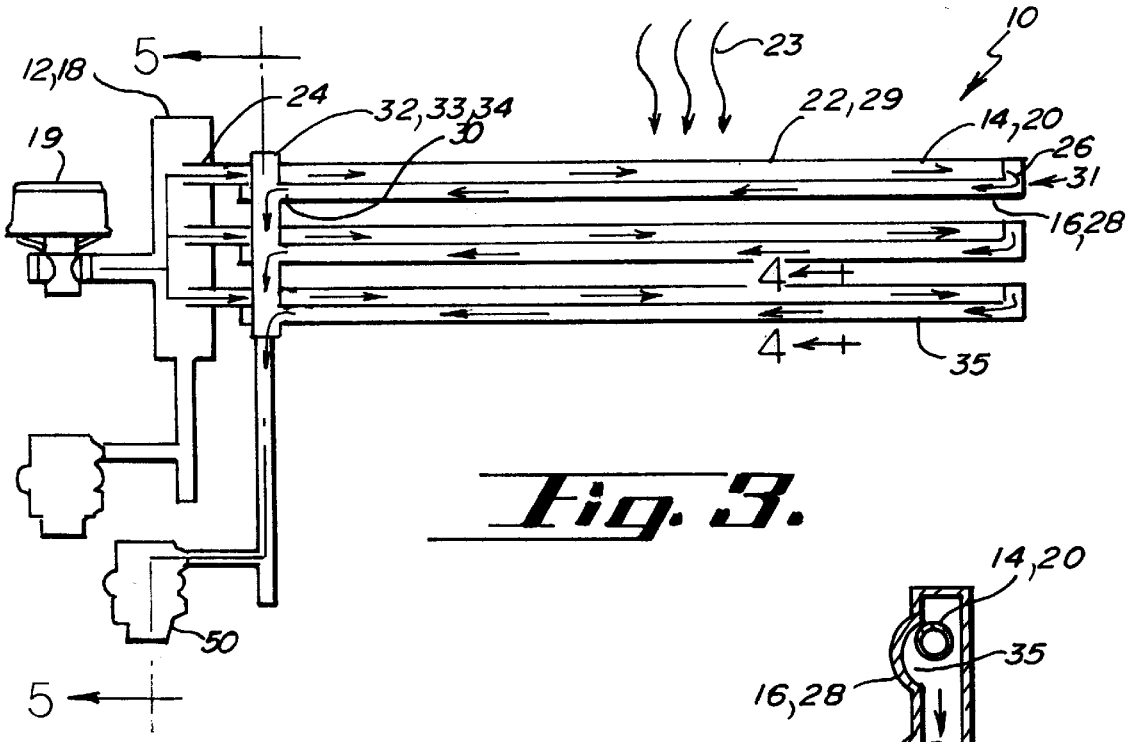
FIG. 3 is a schematic showing the steam distribution device and method of the present invention.

As can best be seen in FIG. 3, the steam distribution device comprises a source of steam 12; a horizontally mounted steam dispersion means 14 for receiving steam from the source of steam and for dispersing a portion of the steam into an air stream; and a horizontally mounted jacket means 16 partially surrounding the steam dispersion means 14.

The source of steam 12 is preferably a header 18 which receives steam from a steam control valve 19 which opens to allow steam into the steam dispersion means when signaled to do so by a humidstat or equivalent humidity sensor. In the sense used here, "header" means the standard dictionary definition of a pipe that serves as a central connection for two or more smaller pipes. However, direct piping into the steam dispersion means, rather than a header, may be used, as for example when there is no need for distribution to multiple pipes.

In the preferred embodiment, the header 18 is preferably vertically oriented so as to take up the minimum space necessary in a duct into which the steam distribution device is inserted. However, the header 18 may be oriented at another angle to the horizontal or may even be horizontal.

The steam dispersion means 14 is preferably an elongate dispersion tube 20 having a number of orifices 22 at intervals along the tube 20; an entrance 24 directly connected to the source of steam 12; and an open exit 26 remote from the entrance 24. The steam dispersion means could alternatively be any device which has orifices to disperse steam into the air stream, such as a cylinder, sphere, etc.

The jacket means 16 preferably is an elongate jacket 28 that partially surrounds the elongate dispersion tube 20 as will be discussed in more detail below. Of course, if the steam dispersion means has another implementation, the jacket means would be different in order to partially surround the steam dispersion means. Alternatively, the jacket 28 might completely surround the steam dispersion means.

In the preferred embodiment, the jacket 28 has a number of second orifices 29 at intervals along the jacket 28. The jacket 28 also has a first end 30 adjacent the entrance 24 and a closed second end 31 adjacent the exit 26. The second end 31 is spaced from the exit 26 along the axis of the dispersion tube 20, and the dispersion tube 20 and jacket 28 communicate with each one another through the open exit 26.

The jacket means 16 and elongate jacket 28 are unconnected to the source of steam 12, as can be seen in the Figures. Thus the jacket 28 does not directly receive steam from the source of steam 12. Rather, the jacket receives steam from the dispersion tube 20.

As can best be seen in FIG. 3, the jacket means 16 and elongate jacket 28 are in flow communication with the steam dispersion means 14 and elongate dispersion tube 20, so that steam flows into the jacket 28 from the open exit 26 of the dispersion tube 20.

The jacket means 16 is for maintaining the temperature of the steam dispersion means 14 at about the temperature of the steam, so as to prevent the formation of condensation in the steam dispersion means.

The steam dispersion device 10 further comprises condensate collection means 32 separate from the source of steam 12 and connected to the jacket means 16 for collecting condensate from the jacket means 16.

In the preferred embodiment, the condensate collection means 30 and condensate collector 33 is a vertically oriented drain tube 34. However, the condensate collection means could be oriented at another angle to the horizontal or could be horizontal.

In the preferred embodiment, the condensate collector 33 communicates with the elongate jacket 28 at first end 30 to receive steam and condensate that has passed through the dispersion tube 20.

The jacket means 16 preferably engages the steam dispersion means 14 along a substantial portion of the jacket means 16 and steam dispersion means 14. Encompassed between the steam dispersion means 14 and jacket means 16, where the two structures do not engage each other, is a chamber 35 that is in flow communication with the steam dispersion means 14.

Figure 4:
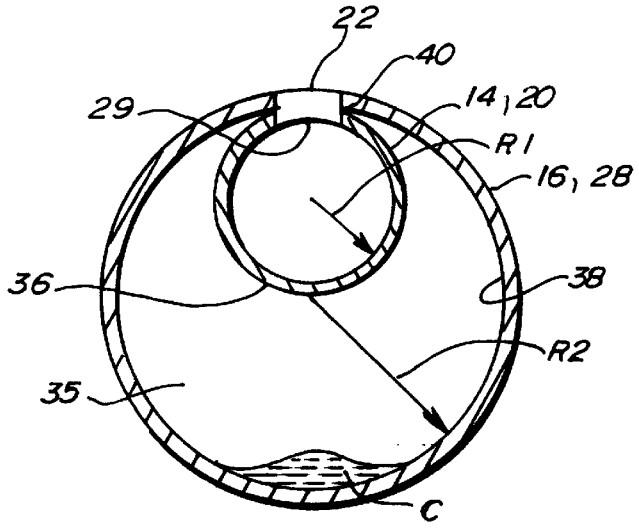
FIG. 4 is a schematic cross-section of the steam distribution device of the present invention along the lines 4 of FIG. 3
Figure 5:
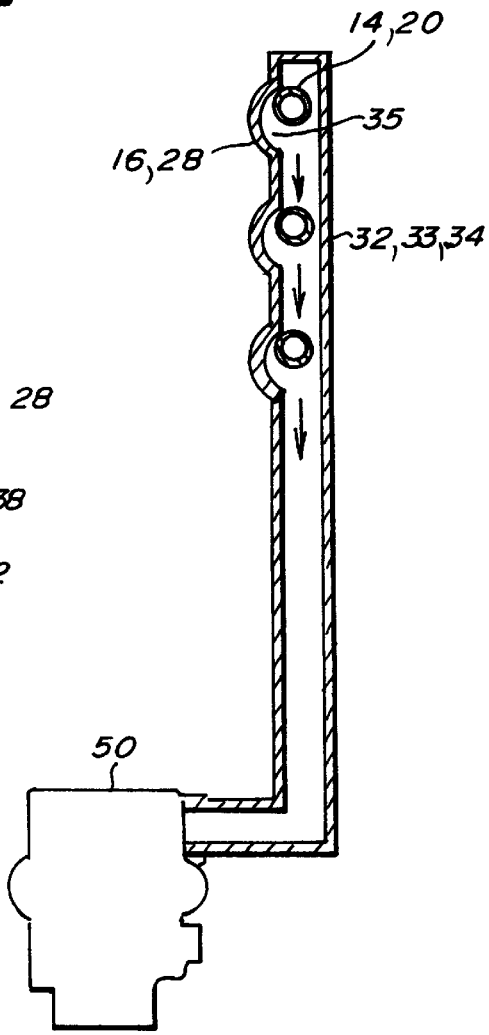
FIG. 5 is a schematic cross-section of the steam distribution device of the present invention along the lines 5 of FIG. 3.

In the preferred embodiment, the jacket means 16 and steam dispersion means 14 are tubular structures, the elongate dispersion tube 20 and elongate jacket 28, respectively, which are joined along a tangent to their surfaces as can best be seen in FIG. 4.

That is, the dispersion tube 20 is preferably cylindrical in cross-section and has a first radius R1 and an outside surface 36. The jacket 28 is also preferably cylindrical and has a second radius R2 greater than the first radius R1 and an inside surface 38. As can be seen in FIG. 4, the outside surface 36 has a tangential portion 40 tangent to the inside surface 38. Further, the orifices 22 and second orifices 29 are in axial alignment and contact one another along the tangential portion 40.

The operation of the steam dispersion device and a description of a method of introducing steam into an air stream according to the present invention will now be given.

Steam from the source of steam 12 or header 18 which has both pure steam and condensate enters the steam dispersion means 14 or elongate dispersion tube 20 at the entrance 24. Steam then travels along the dispersion tube 20 in the direction shown by the arrows, exiting the dispersion tube 20 through the orifices 22 and entering the air stream 23. Initially, steam and a slight amount of condensate may exit through the orifices 22, because the dispersion tube 20 is cold for a very short interval.

Steam then exits the dispersion tube 20 at the exit 26 and enters the jacket 28, traveling in a reverse direction along the steam dispersion tube 26 within the chamber 35. As it does so, the steam heats the dispersion tube 20 very quickly, almost instantaneously, to the temperature of the steam.

It will be seen that, because the dispersion tube 20 is quickly, even instantaneously, heated to steam temperature, it will thereafter have no tendency to produce condensate. Further, because the steam dispersion tube 20 and jacket 28 are joined tangentially along a substantial portion of their length at the tangential portion 40, there is no dead space between the dispersion tube 20 and jacket 28 along the incoming path of the steam where condensate can be produced.

Also, because the first orifices 22 and second orifices 29 are axially aligned and contact one another along the tangential portion 40, the steam has essentially no distance to travel from the jacket 28 to pass through the dispersion tube 20. Thus, steam will exit the orifices 22 at a high velocity, promoting dispersion into the air stream.

Any condensate (C, FIG. 4) that does form in the dispersion tube 20 or jacket 28 is quickly blown by the steam out of the first end 30 and into the condensate collector 33. In the preferred embodiment, condensate than drains under the influence of gravity down the vertically oriented drain tube 34 and into a trap 50. Steam pressure may also assist this draining.

Because the device 10 has very little tendency to form condensate within the dispersion tube 20, and because any tiny amount of condensate that does form is quickly blown into the jacket 28 and thence to the collector 33, the dispersion tube 20 can be mounted "dead level" or completely horizontally in a duct, unlike any other device of the prior art. This saves a great deal of space in the duct, allowing multiple parallel dispersion tubes 20 to be mounted as shown in the FIG. 3. That is, it will be clear to one of ordinary skill in the art that, a group of parallel, horizontal dispersion tubes will take up less vertical space than a similar group of parallel tubes inclined at an angle to the horizontal.

In prior art systems, the dispersion tubes could generally not be mounted "dead level", and if an attempt was made to mount the tubes "dead level", the headers had to be mounted at an angle to the horizontal to promote drainage.

The jacket 28 is not heated until the steam control valve 19 opens. Therefore, the device 10 does not take up air conditioning BTUs like prior art heated jackets.

Unlike earlier cold tube systems, insulating devices or "fenders" are not needed to prevent condensation within the dispersion tube by the cool air stream.

Because the orifices of the dispersion tube and jacket are radially aligned and contact one another, there is no need for special nozzles in the orifices to permit steam to escape while preventing the escape of condensate. The system therefore produces a higher overall flow of steam, resulting in more efficient humidification.

A second embodiment of the present invention is generally shown in the Figures as reference numeral 110.

Figure 6:
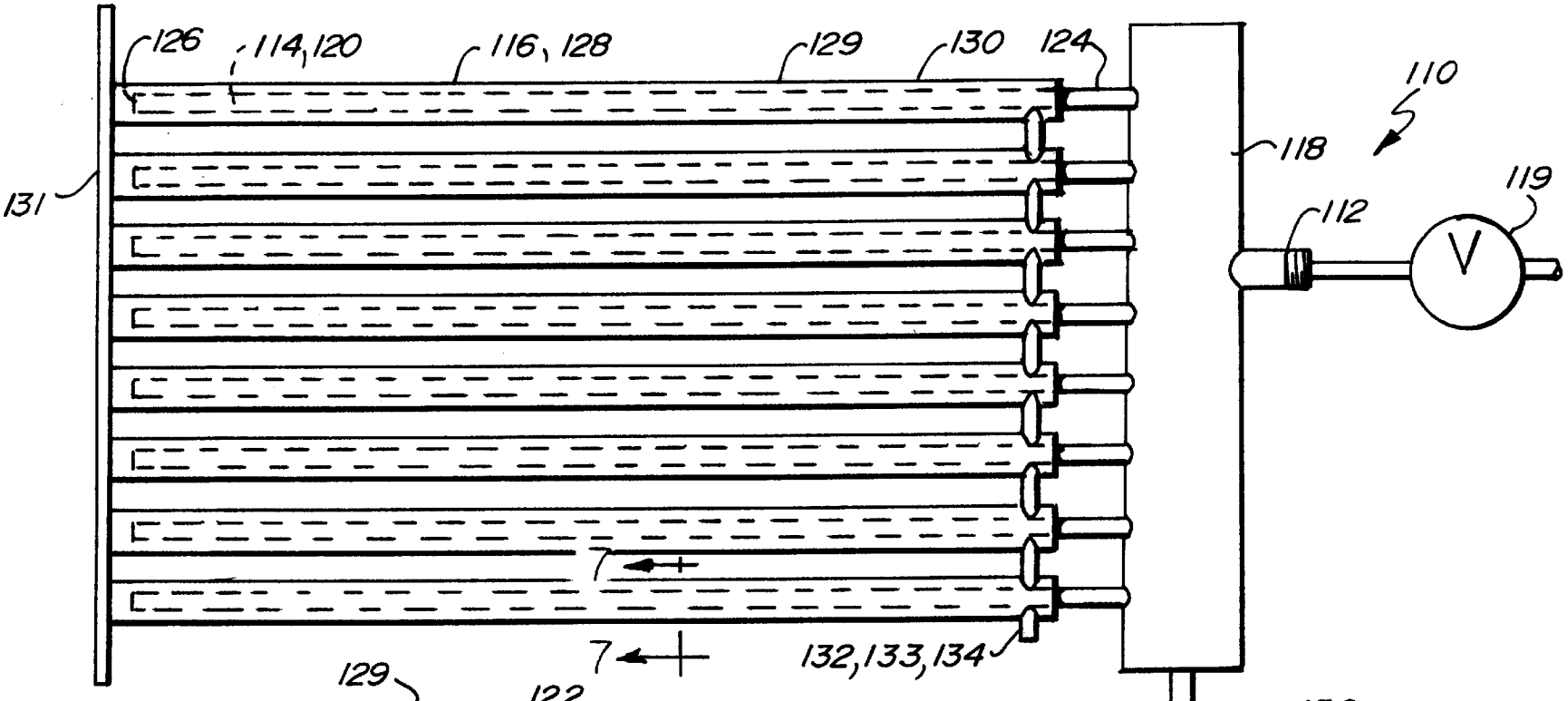
FIG. 6 is a schematic showing a second embodiment of the steam distribution device and method of the present invention.

As can best be seen in FIG. 6, the steam distribution device comprises a source of steam 112; a horizontally mounted steam dispersion means 114 for receiving steam from the source of steam and for dispersing a portion of the steam into an air stream; and a horizontally mounted jacket means 116 substantially surrounding the steam dispersion means 114.

The source of steam 112 is preferably a header 118 which receives steam from a steam control valve 119 which opens to allow steam into the steam dispersion means when signaled to do so by a humidstat or equivalent humidity sensor. In the sense used here, "header" means the standard dictionary definition of a pipe that serves as a central connection for two or more smaller pipes. However, direct piping into the steam dispersion means, rather than a header, may be used, as for example when there is no need for distribution to multiple pipes.

In the preferred embodiment, the header 118 is preferably vertically oriented so as to take up the minimum space necessary in a duct into which the steam distribution device is inserted. However, the header 118 may be oriented at another angle to the horizontal or may even be horizontal.

The steam dispersion means 114 is preferably an elongate dispersion tube 120 having a number of orifices 122 at intervals along the tube 120; an entrance 124 directly connected to the source of steam 112; and an open exit 126 remote from the entrance 124. The steam dispersion means could alternatively be any device which has orifices to disperse steam into the air stream, such as a cylinder, sphere, etc.

The jacket means 116 preferably is an elongate jacket 128 that substantially surrounds the elongate dispersion tube 120 as will be discussed in more detail below. Of course, if the steam dispersion means has another implementation, the jacket means would be different in order to partially surround the steam dispersion means. Alternatively, the jacket 128 might completely surround the steam dispersion means.

In the preferred embodiment, the jacket 128 has a number of second orifices 129 at intervals along the jacket 128. The jacket 128 also has a first end 130 adjacent the entrance 124 and a closed second end 131 adjacent the exit 126. The second end 131 is spaced from the exit 126 along the axis of the dispersion tube 120, and the dispersion tube 120 and jacket 128 communicate with each one another through the open exit 126.

The jacket means 116 and elongate jacket 128 are unconnected to the source of steam 112, as can be seen in the Figures. Thus the jacket 128 does not directly receive steam from the source of steam 112. Rather, the jacket receives steam from the dispersion tube 120.

Figure 7:
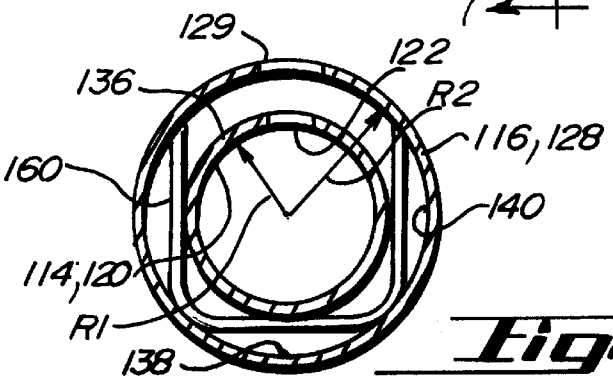
FIG. 7 is a schematic cross-section of the second embodiment along the lines 7 of FIG. 6.

As can best be seen in FIG. 6, the jacket means 116 and elongate jacket 128 are in flow communication with the steam dispersion means 114 and elongate dispersion tube 120, so that steam flows into the jacket 128 from the open exit 126 of the dispersion tube 120. In the second embodiment, the jacket 128 is spaced from the dispersion tube 120, so that a chamber 140 is formed between the jacket 128 and the dispersion tube 120 about the entire circumference of the dispersion tube 120. The chamber 140 is in flow communication with the dispersion tube 120 through the open exit 126. A bracket 160 supports the dispersion tube 120 within the jacket 128 and is preferably attached to the inner surface 138 of the jacket 128 and to the outer surface 136 of the dispersion tube 120, as shown in FIG. 7. The bracket 160 is preferably U-shaped to support the cylindrical dispersion tube 120 at three points of attachment.

The jacket means 116 is for maintaining the temperature of the steam dispersion means 114 at about the temperature of the steam, so as to prevent the formation of condensation in the steam dispersion means.

The steam dispersion device 110 further comprises condensate collection means 132 separate from the source of steam 112 and connected to the jacket means 116 for collecting condensate from the jacket means 116.

In the preferred embodiment, the condensate collection means 130 and condensate collector 133 is a vertically oriented drain tube 134. However, the condensate collection means could be oriented at another angle to the horizontal or could be horizontal.

In the preferred embodiment, the condensate collector 133 communicates with the elongate jacket 128 at first end 130 to receive steam and condensate that has passed through the dispersion tube 120.

In the preferred embodiment, the jacket means 114 and steam dispersion means are tubular structures, the elongate dispersion tube 120 and elongate jacket 128, respectively.

That is, the dispersion tube 120 is preferably cylindrical in cross-section and has a first radius R1 and an outside surface 136. The jacket 128 is also preferably cylindrical and has a second radius R2 greater than the first radius R1 and an inside surface 138. As can be seen in FIG. 7, the dispersion tube 120 and jacket 128 are spaced from each other, forming a chamber 140 therebetween. Further, the orifices 122 and second orifices 129 are in axial. The orifices 122 and 129 are unconnected to each other. That is, there is no insert between the orifices, as in the Bahler patent.

The operation of the steam dispersion device and a description of a method of introducing steam into an air stream according to the present invention will now be given.

Steam from the source of steam 112 or header 118 which has both pure steam and condensate enters the steam dispersion means 114 or elongate dispersion tube 120 at the entrance 124. Steam then travels along the dispersion tube 120, exiting the dispersion tube 120 through the orifices 122 and entering the air stream. Initially, steam and a slight amount of condensate may exit through the orifices 122, because the dispersion tube 120 is cold for a very short interval.

Steam then exits the dispersion tube 120 at the exit 126 and enters the jacket 128, traveling in a reverse direction along the steam dispersion tube 126 within the chamber 140. As it does so, the steam heats the dispersion tube 120 very quickly, almost instantaneously, to the temperature of the steam.

It will be seen that, because the dispersion tube 120 is quickly, even instantaneously, heated to steam temperature, it will thereafter have no tendency to produce condensate.

Applicant has found that spacing the axially-aligned orifices 122, 129 from each other across the chamber 140 markedly increases the amount of water vapor that may be dispersed into the air stream without condensate. For example, prior art vaporizers could disperse a maximum of 30 lbs/hr of water vapor without substantial condensate dispersion. The first embodiment of the invention described herein can disperse up to 70 lbs/hr of water vapor without substantial condensate dispersion. The second embodiment can disperse up to 150 lbs./hr of water vapor without substantial condensate dispersion. Although a complete theory has not been developed, applicant believes that the second embodiment works better because the space between the orifices 122 and 129 tends to prevent condensate from entering the airstream. That is, any condensate formed along surfaces of the dispersion tube 120 is carried out by the force of steam pressure in the chamber 140 before it can fly across the chamber 140 to the second orifices 129.

The second embodiment also has an advantage over the Bahler patent in that there is no need for inserts between the dispersion tube 120 and the jacket 128. This has the effect of increasing the velocity at which steam enters the air stream.

Any condensate that does form in the dispersion tube 120 or jacket 128 is quickly blown by the steam out of the first end 130 and into the condensate collector 133. In the preferred embodiment, condensate than drains under the influence of gravity down the vertically oriented drain tube 134 and into a trap 150. Steam pressure may also assist this draining.

Because the device 110 has very little tendency to form condensate within the dispersion tube 120, and because any tiny amount of condensate that does form is quickly blown into the jacket 128 and thence to the collector 133, the dispersion tube 120 can be mounted "dead level" or completely horizontally in a duct, unlike any other device of the prior art. This saves a great deal of space in the duct, allowing multiple parallel dispersion tubes 120 to be mounted as shown in the FIG. 6. That is, it will be clear to one of ordinary skill in the art that, a group of parallel, horizontal dispersion tubes will take up less vertical space than a similar group of parallel tubes inclined at an angle to the horizontal.

In prior art systems, the dispersion tubes could generally not be mounted "dead level", and if an attempt was made to mount the tubes "dead level", the headers had to be mounted at an angle to the horizontal to promote drainage.

The jacket 128 is not heated until the steam control valve 119 opens. Therefore, the device 110 does not take up air conditioning BTUs like prior art heated jackets.

Unlike earlier cold tube systems, insulating devices or "fenders" are not needed to prevent condensation within the dispersion tube by the cool air stream.

Because the orifices of the dispersion tube and jacket are radially aligned, there is no need for special nozzles in the orifices to permit steam to escape while preventing the escape of condensate. The system therefore produces a higher overall flow of steam, resulting in more efficient humidification.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A steam distribution device for a steam humidification system comprising, (a) source of steam;

(b) horizontally mounted steam dispersion means for receiving steam from said source of steam and for dispersing a portion of the steam into an air stream, said steam dispersion means having an open exit distal from said source of steam and a plurality of dispersing steam;

(c) horizontally mounted jacket means substantially surrounding said steam dispersion means and unconnected to said source of steam for maintaining the temperature of said steam dispersion means at about the temperature of the steam, said jacket means being in flow communication with said dispersion means through said open exit and hereby receiving steam from said dispersion means;

(d) condensate collection means separate from said source of steam connected to said jacket means for collecting condensation from said jacket means; and (e) said jacket means being spaced from said dispersion means and further comprising a chamber between said jacket means and said steam dispersion means, said chamber being in flow communication with said steam dispersion means.

2. The steam distribution device of claim 1, wherein said jacket means and said steam dispersion means are concentric tubular structures.

3. The steam distribution device of claim 1, wherein said source of steam further comprises a vertically oriented supply header.

4. The steam distribution device of claim 1, wherein said condensate collection means further comprises a vertically oriented drain tube.

5. The steam distribution device of claim 1, further comprising a bracket attached to the inner surface of said jacket means and to said dispersion means and adapted to support said dispersion means within said bracket means.

6. The steam distribution device of claim 5, wherein said bracket is U-shaped.

7. The steam distribution device of claim 1, further comprising a plurality of aligned orifice pairs in said dispersion means and said jacket means.

8. A steam distribution device for a steam humidification system, comprising:

(a) a source of steam;

(b) a horizontally-mounted elongate dispersion tube having a number of orifices at intervals along said tube, an entrance directly connected to said source of steam and an open exit remote from said entrance.

(c) a horizontally-mounted elongate jacket unconnected to said source of steam and substantially surrounding said dispersion tube and having a number of second orifices at intervals along said jacket, a first end adjacent said entrance and a closed second end adjacent said open exit, said second end being spaced from said open exit along the axis of said dispersion tube, said dispersion tube and said jacket communicating with one another through said open exit; and (d) a condensate collector separate from said source of steam and communicating with said elongate jacket at said first end for receiving steam and condensate.

9. The steam distribution device of claim 8, wherein said dispersion tube is cylindrical and has a first radius and an outside surface, said jacket is cylindrical and has a second radius greater than said first radius and an inside surface, further comprising a chamber between said jacket and said dispersion tube, and further comprising a bracket connected to the inside surface of said jacket and to the outside surface of said dispersion tube, and wherein said orifices and said second orifices are in axial alignment.

10. The steam distribution device of claim 8, further comprising a duct carrying air to be humidified and said distribution device being mounted horizontally within said duct.

11. The steam distribution device of claim 10, wherein said source of steam further comprises a vertically mounted supply header.

12. The steam distribution device of claim 10, wherein said condensate collector further comprises a vertically mounted drain tube.

13. The steam distribution device of claim 8, wherein said orifices and said second orifices are unconnected to each other.

14. A steam distribution device for a steam humidification system, comprising:

(a) a source of steam;

(b) a horizontally-mounted elongate dispersion tube having a number of orifices at intervals along said tube, an entrance directly connected to said source of steam and an open exit remote from said entrance, (c) a horizontally-mounted elongate jacket unconnected to said source of steam and substantially surrounding said dispersion tube and having a number of second orifices at intervals along said jacket, a first end adjacent said entrance and a closed second end adjacent said open exit, said second end being spaced from said open exit along the axis of said dispersion tube, said dispersion tube and said jacket communicating with one another through said open exit;

(d) wherein said dispersion tube is cylindrical and has a first radius and an outside surface, said jacket is cylindrical and has a second radius greater than said first radius and an inside surface, further comprising a chamber between said jacket and said dispersion tube, and further comprising a bracket connected to the inside surface of said jacket and to the outside surface of said dispersion tube, and wherein said orifices and said second orifices are in axial alignment; and (e) a condensate collector separate from said source of steam and communicating with said elongate jacket at said first end for receiving steam and condensate.

15. The steam distribution device of claim 14, further comprising a duct carrying air to be humidified and said distribution device being mounted horizontally within said duct.

16. The steam distribution device of claim 15, wherein said source of steam further comprises a vertically mounted supply header.

17. A method of introducing steam into an air stream to humidify the air stream, comprising the steps of:

(a) inserting steam from a source of steam into a first concentric structure within a second concentric structure, said first structure being spaced from said second structure and thereby forming a chamber between said first structure and said second structure, said first and second structures communicating with one another through said chamber, said second structure having no direct connection with the source of steam and wherein said first structure and said second structure are mounted horizontally in the air steam, said first concentric structure having an open exit distal from said source of steam and said second concentric structure receiving steam from first concentric structure said open exit;

(b) reversing the direction of travel of the steam whereby the steam passes within said chamber outside said first concentric structure, thereby maintaining the temperature of said first concentric structure at about the temperature of the steam;

(c) dispersing the steam into the air stream from a plurality of aligned orifices spaced along said first and second structures; and (d) collecting any condensate from said second concentric structure.

18. The method of claim 17, further comprising the step of connecting said first structure to a vertically mounted steam supply header.

19. The method of claim 18, further comprising the step of connecting said second structure to a vertically mounted drain tube.

* * * * *

UNITED STATES PATENT AND TRADEMARK OFFICE

CERTIFICATE OF CORRECTION

PATENT NO. : 6,227,526 B1
APPLICATION NO. : 09/274558
DATED : May 8, 2001
INVENTOR(S) : Williard E. Morton It is certified that error appears in the above-identified patent and that said Letters Patent is hereby corrected as shown below:

Column 1, line 4, before the word "U.S.", please insert --co-pending--.

Column 9, line 57, before the word "source", please insert --a--.

Column 9, line 62, after the word "of" please insert --orifices for--.

Column 10, line 3, please delete "hereby", and insert in its place --thereby--.

Column 12, line 15, please delete "steam", and insert in its place --stream--.

Column 12, line 18, after the word "from", please insert --said--.

Column 12, line 18, after the word "structure", please insert --through--.

Signed and Sealed this

Fifteenth Day of January, 2008

JON W. DUDAS
*Director of the United States Patent and Trademark Office*